United States Patent [19]

Austill et al.

[11] Patent Number: 4,793,577

[45] Date of Patent: Dec. 27, 1988

[54] LOCOMOTIVE CURVE TRACKING SYSTEM

[76] Inventors: Robert J. Austill, 2236 Dianne Dr., Santa Clara, Calif. 95050; Joseph M. Lambert, P.O. Box 862, Lincoln, Calif. 95648

[21] Appl. No.: 940,599

[22] Filed: Dec. 11, 1986

[51] Int. Cl.[4] ..... B61L 25/00

[52] U.S. Cl. ..... 246/107; 73/146; 246/122 R; 346/1.1; 346/33 R

[58] Field of Search ..... 73/146, 181; 33/1 Q, 33/1 N, 1 PT, 144, 146, 331, 1 CC; 246/107, 122 R, 122 A, 123, 185, 1 C, 108, 169 R; 346/1.1, 33 R

[56] References Cited

U.S. PATENT DOCUMENTS

| | | | |
|---|---|---|---|
| 1,444,886 | 2/1923 | Rounds | 346/1.1 |
| 1,516,809 | 11/1924 | Duncan | 246/185 |
| 1,843,959 | 2/1932 | Sperry | 33/1 Q |
| 2,363,416 | 11/1944 | Henroteau | 246/122 R |
| 2,978,904 | 4/1961 | Bereznai | 73/146 |
| 3,869,907 | 3/1975 | Plasser et al. | 73/146 |
| 3,992,935 | 11/1976 | Schubert | 73/146 |
| 4,103,547 | 8/1978 | Vrabel | 73/146 |
| 4,285,483 | 8/1981 | Cipollone | 246/107 |

*Primary Examiner*—Robert B. Reeves
*Assistant Examiner*—Scott H. Werny
*Attorney, Agent, or Firm*—Freilich, Hornbaker, Rosen & Fernandez

[57] ABSTRACT

The position of an event, such as emergency braking, of a railroad vehicle enroute on a track mapped on a chart is accurately recorded by continually sensing the degree and direction of track curvature, and recording the track curvature and event data for later display. Speed is also recorded as a function of time to provide a scale as an aid to interpolation of a recorded event position between recorded curves. The event position thus recorded and identified by nearby curves in the track is accurate to within a small fraction of a mile.

9 Claims, 6 Drawing Sheets

LOCOMOTIVE CURVE TRACKING SYSTEM

BACKGROUND OF THE INVENTION

This invention relates to a system on a locomotive or other railroad vehicle for sensing and continually recording the track curvature on a railroad, particularly in an event recorder so that, upon playback for display of the recorded information, the position of the vehicle may be determined with precision.

It is common practice for locomotives to have event recorders that are analogous to "black boxes" on aircraft. They are used to continuously record on magnetic tape various locomotive conditions, and the railroad engineer's controlling actions. The tape is usually provided in a cassette in the form of a continuous loop and always contains the most recent 12 hours of information.

When desired, the information thus stored is read out and displayed on a continuous sheet of paper. In the case of analog information, it is displayed in the form of an oscillogram with a separate channel for each item of information. The paper is preprinted with scales so that the various analog channels of information can be quantified. Other information also displayed on the continuous sheet of paper may be digital.

A typical event recorder may have two analog channels for speed and traction motor amperage. Other information recorded in digital form includes cumulative distance (e.g. in miles), train air-brake line pressure, throttle position, traction motor amperage, reverser handle position, dynamic brake system activated, and elapsed time. Other systems can have fewer or additional measurements.

In reading out the stored information, a typical event recorder system will print out the speed information as a continuous analog graph with incremental distances indicated by "blips" (momentary deflections of the speed recording pen) as internally calculated by an event record reader as a function of speed and time.

Speed information is derived from the RPM of the locomotive wheels so that indicated speed, which is dependent on exact locomotive wheel diameter, may differ from the true speed. For example, if the wheel diameter is less than a predetermined diameter by one percent for whatever reason, the actual speed will be less, and the distance calculated based on speed will be in error by two miles after traveling 200 miles. The cumulative error in a 12 hour period may thus be as much as five to seven miles. This lack of reliable, precise location information diminishes the value of the event recorder.

The series of curves in a railroad track (the sequence of bends to the left and to the right, and their degrees of curvature and lengths on a segment of railroad) is as unique as a fingerprint, because all track alignment is dependent on terrain. Virtually every American railroad company has documents which describe the characteristics of its branch lines and all segments of main tracks, known as track charts. Track charts describe the principal features of each segment, giving milepost locations, locations of bridges, equipment, towns and sidings, and in particular, for the purpose of this invention, providing a description, curve number, and location of every track curve. Curvatures to the left and right in the direction of travel and the lengths of transition curves from straight track to curvature of the main body of the curve are described, and the degree of curvature of the main body of each curve is specified.

"Degree of curvature" of American railroads is defined as the angle at the center point of the curve which is subtended by a 100-foot chord on the main body of the curve. Mainline tracks generally fall in the range of 0° to 10°, with occasional curves up to 15° or so. Yard, spur, and industry tracks can have curvatures as great as 35°, and sometimes more.

Track curvature information recorded simultaneously with the other data described above can be used to enhance the usefulness of event recorders installed on railroad locomotives. The curve information generated aboard a moving train could be used in conjunction with incremental distance for the purpose of locating the exact position of an event occurring on the track with an accuracy of less than a quarter, or even a tenth, of a mile.

A track curvature signal can be developed from aboard a locomotive in several ways. The most direct way is to effectively measure the angle of swivel of one or both trucks of the locomotive. A less direct, but equally viable way, is to measure the angle between two rail vehicles, such as the angle in plan view between the locomotive and a rail vehicle next ahead or behind it. However, both ways have a characteristic which, under ordinary conditions, would make the direct (obvious) transducer arrangement for generating a curvature signal unacceptably inaccurate. The locomotive trucks (the wheel assembly and frame) have a feature called "lateral motion" which permits the body of the locomotive, and of other rail vehicles, to move laterally relative to the track centerline (and therefore to the trucks) in order to soften the ride in that direction.

The coupler and draft gears on railroad locomotives and other rail vehicles are arranged to permit some relative longitudinal movement between any two vehicles (they become closer together or farther apart), also partly for the purpose of softening the riding qualities—this time in the longitudinal direction. Once again, this feature makes the direct (obvious) transducer arrangements unacceptably inaccurate and/or cumbersome. One of the objectives of this invention is to provide a transducer arrangement for generating a curvature signal on board a vehicle which overcomes the shortcomings that normally would occur when lateral displacement of the rail vehicle trucks or longitudinal displacement between rail vehicles occurs.

SUMMARY OF THE INVENTION

In accordance with this invention, a transducer is provided for producing a signal proportional to the curvature of track being traversed by a locomotive for contemporaneous storage in an event recorder with other information, such as speed and throttle position, in order that the exact location where each event occurred can be determined when the information is read out of the recorder. The curvature transducer is comprised of two linear motion transducers and their supporting equipment for at least one truck of a locomotive.

The trucks of other vehicles could be similarly equipped; reference is here made to the locomotive only because it normally carries the event recorder. Consequently, the term "vehicle," as used hereinafter to define the invention in the claims, is to be understood to include locomotives, cabooses, freight cars, track geometry cars, and any other vehicles adapted to travel upon the railroad, either under its own power or that of a locomotive.

One linear motion transducer is connected between one corner of the truck and one side of the railroad vehicle, and the other is connected between a diametrically opposite corner of the truck and the other side of the vehicle. The transducers are connected electrically in series with a voltage source and mechanically in phase with truck swivel so that, as the vehicle traverses a curve and the truck swivels relative to the vehicle in proportion to the curvature of the railroad being traversed, both transducers effect a change in signal amplitude (current or voltage) in the same direction (increase or decrease) that is proportional to the displacement of each end of the truck from the side of the vehicle. The signal output of each transducer thus adds to the displacement signal of the other to increase sensitivity, but more important the signal output of each cancels any displacement signal of the other produced by lateral motion of the truck relative to the vehicle.

For greater sensitivity, two linear motion transducers connected between diametrically opposite corners of a second truck and the sides of a vehicle are connected electrically in series with the linear motion transducers of the first truck, but affixed to opposite corners so that, as the vehicle traverses a curve and the trucks swivel oppositely, their output signals added in series will vary in the same direction (increase or decrease in amplitude). The two transducers of each truck will cancel any change in signal amplitude due to any lateral motion of the trucks relative to the vehicle.

The track curvature signal is recorded in a separate channel of an event recorder contemporaneously with speed, elapsed time, and other information. This signal not only shows where curves occur and the degree or sharpness of the curve, but also whether the curve is left or right hand. When read out and displayed on a separate channel together with other information, including speed and elapsed time, incremental distances of less than a mile are computed as a function of speed and elapsed time, and recorded as blips on the speed trace. It is then possible to locate the position of an event on a railroad track chart with precision by first locating it relative to identified left and right hand curves on a track chart from recorded curve information, and then interpolating position between the ends of curves with the aid of the incremental distance information displayed as blips on the speed trace or on a separate channel.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
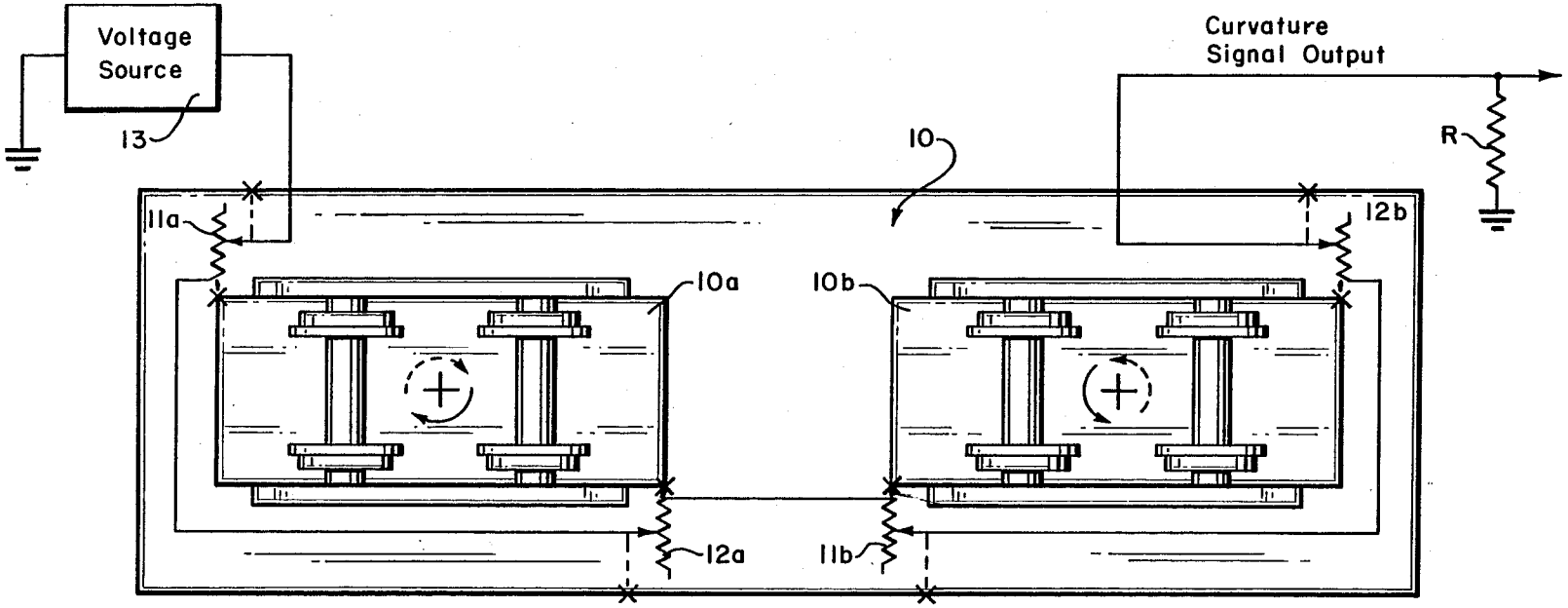
FIG. 1 illustrates the arrangement of two linear motion transducers on each of two trucks of a railroad vehicle in accordance with a preferred embodiment of the invention.

Referring now to FIG. 1, which schematically illustrates railroad trucks 10*a* and 10*b* on the bottom of a railroad vehicle 10, an arrangement for curvature transducers is shown which overcomes the shortcomings referred to above. It consists of at least two linear motion transducers 11*a* and 12*a* connected between the diametrically opposite corners of one truck 10*a* and the opposite sides of the vehicle 10, and preferably four linear motion transducers, the second pair 11*b* and 12*b* being oppositely affixed between diametrically opposite corners of the second truck 10*b* and the sides of the vehicle, i.e., on corners of the truck 10*b* opposite the corners used for the truck 10*a*.

Figure 1A:
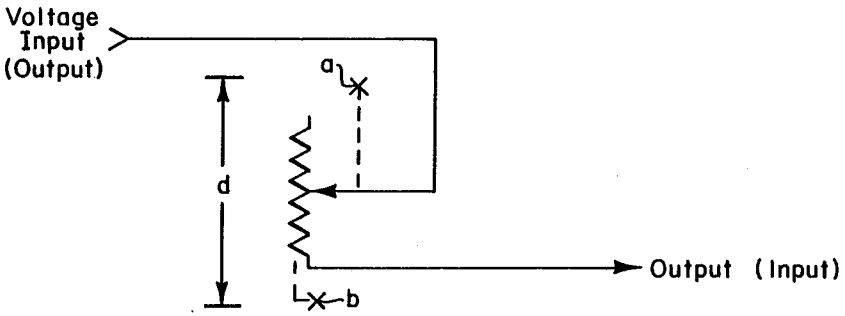
FIG. 1*a* illustrates schematically one linear motion transducer.

A single transducer is shown schematically in FIG. 1*a* as a potentiometer, as the distance d between points a and b increases and decreases, the position of the wiper changes to increase or decrease the electrical resistance between a voltage input (output) terminal and an output (input) terminal. Points a and b are fixed on the side of the railroad vehicle and the corner of the truck respectively. The transducers are connected in series with a voltage source 13, and mechanically in phase with truck swivel as shown in FIG. 1, so that in traversing a curve, the signals generated by the transducers will add in phase, i.e., will both be increasing or decreasing and added.

Each linear motion position transducer, shown schematically as a potentiometer, is comprised of a smooth cylindrical resistance tube about one foot long with an internal wiper. A suitable linear motion position transducer is manufactured by Systron Donner, such as a Model 112, which allows travel of the wiper up to 12 inches. Other models allow travel over different distances, such as 6, 9, 18, 24, 30 and 36 inches. In appearance, the transducer resembles a shock absorber with the cylinder attached to one body, such as the truck, and the rod attached to the side of the railroad vehicle. However, the rod only moves a wiper in a resistance tube within the cylinder, not a hydraulic piston, and the wiper and resistance tube are each electrically isolated from the rod and cylinder, and external electrical connections are made only to the rod at one end and the resistance tube at the other end.

Figure 2A:
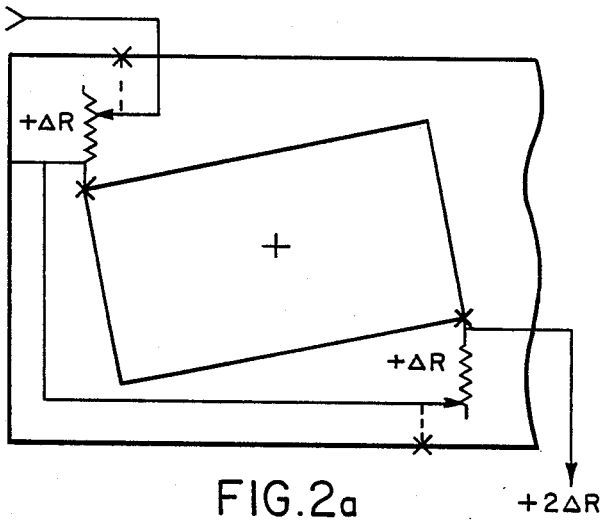
FIG. 2*a* illustrates the effect of swivel of a truck in FIG. 1 for a right-hand curve.

The voltage source is connected to the wiper on the rod mechanically affixed to a point on the side of the vehicle indicated by an X, and the signal output is taken from one end of the tube which is mechanically affixed to one corner of the truck as indicated by an X. Each X represents a pivotal mechanical connection. The cylindrical resistance tube is oriented generally perpendicular to the side of the vehicle (when the truck axis is in line with the vehicle axis), with the end thereof that is not electrically connected nearest the side of the vehicle. It can be readily appreciated that, as the truck 10*a* swivels counterclockwise, as shown in FIG. 2*a*, the signal at the output of the transducer 11*a* will increase in amplitude, as will the signal at the output of the transducer 12*a*. By connecting them in series, the swivel signals generated will add in phase, i.e., the swivel signal output of transducer 12*a* added to the swivel signal output of transducer 11*a* will also increase. As the truck swivels clockwise, the output signals added will both be decreasing.

It can be appreciated that in traversing a curve, both trucks will swivel oppositely, so that by affixing the pairs of transducers to the trucks oppositely, i.e., to opposite corners, swivel of the the trucks in opposite directions will produce an output signal from each of the serially connected transducers which will be in phase, all either increasing or decreasing. This further increases sensitivity. The output signal of the two pair of transducers in series is taken across a resistor R.

Figure 2B:
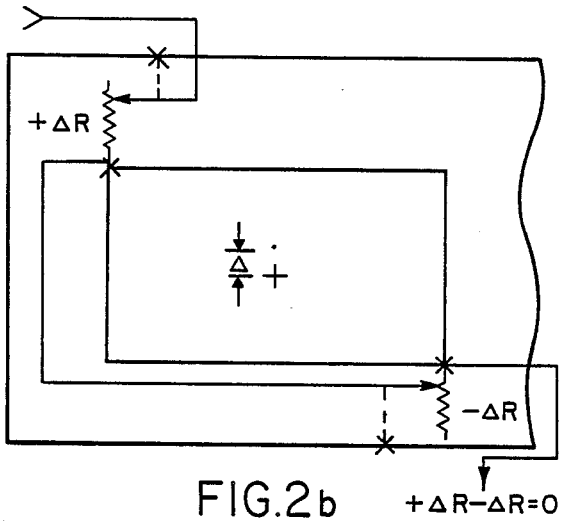
FIG. 2*b* illustrates the effect of lateral motion of the truck in FIG. 2*a* relative to the vehicle.

If the railroad vehicle should shift laterally on the truck at any time, such as upon entering or leaving a curve, the positions of the wipers on the paired transducers will shift correspondingly. This shift of the wipers on the paired transducers is in addition to the shift due to swivel motion, and may be even greater than the swivel motion. However, the effect of the lateral shift of the truck relative to the vehicle will be cancelled by the fact that the transducers of each truck are oriented oppositely, and since both ends of the truck will shift in the same direction relative to the vehicle, the lateral motion sensed by the paired transducers affixed to the truck will cancel, as illustrated in FIG. 2*b*. The same is true of the other truck of the vehicle, if both trucks are provided with transducers. In that way, cancellation of the effect of lateral motion is achieved while doubling the sensitivity to swivel motion using two pair of linear motion transducers mechanically connected between opposite ends of the trucks and the sides of the vehicle, and using opposite corners of the two trucks, while electrically connecting the transducers in series and in phase, which is, as noted above, connecting the transducers in series and in a sense that all produce an increasing (or decreasing) swivel signal. Contribution from all transducers for swivel motion of the trucks relative to the vehicle will thus be made while traversing a curve with cancellation of the effect of any lateral shift of the trucks relative to the vehicle.

The linear motion transducers are illustrated in FIG. 1*a* as devices whose resistance between attaching points a and b on the vehicle and the truck, respectively, varies linearly as the distance between the points varies in a direction parallel to the dimension line d in FIG. 1*a*. It is apparent that as the vehicle traverses a track curve, the attaching point b on the truck travels on a radius rather than in a straight line. However, on a typical vehicle, particularly a locomotive, the truck's swivel is only approximately 1.07° when traversing a 10° track curve. Since the maximum track curvature likely to be encountered is 15°, the trucks would each swivel only about 1.6° and the signal from the transducer of FIG. 1*a* will be amply linear, i.e., the resulting transducer error occurring because the truck attaching point b travels on a radius is so small (approximately 0.015%) as to be insignificant for purposes of determining track curvature. However, although the angle through which the truck travels is small (1.07° for a 10° track curve) the displacement of the transducer attaching point b on the truck relative to attaching point a on the vehicle is large enough to provide good sensitivity. For a truck frame ten feet long, a 1.07° swivel will displace the attaching points at each end 1.12°, which is well within the boundaries of accurate measurement for a variety of kinds of linear motion transducers.

As noted above, a reasonable range of track curvature to be recorded would be 0° to 15° left or right from a straight track. In that case, the signal would be processed before recording to produce a linear voltage signal offset from a reference by a maximum voltage for a maximum curve, such as five volts for a 15° curve to the right, and a linear signal offset of five volts in the opposite direction from the reference for a maximum 15° curve to the left. It would be useful to have the capability of designating (assigning) the left hand and right hand indicating polarity of the recorded signal. However, notwithstanding this 15° maximum track curve, the transducers must be able to undergo additional displacement in order to accommodate lateral motion between the vehicle and its trucks, and in order to occasionally traverse more sharply curved secondary tracks. Even though the curvature information signal would not be reliably linear for curves exceeding 15°, the information would still be useful in showing where such a sharp curve has been encountered.

Figure 3:
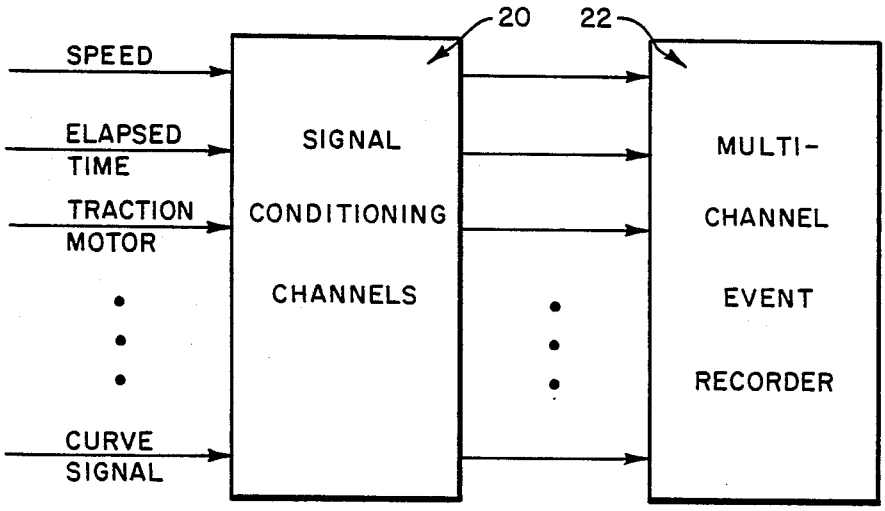
FIG. 3 is a functional block diagram of an event recorder.

FIG. 3 illustrates in a general block diagram a system for recording signals derived from various transducers aboard a locomotive or other vehicle. Aside from the various transducers (not shown), the system consists essentially of only two parts, a first part 20 having signal conditioning channels, one for each signal to be recorded, and a multichannel event recorder 22 comprised of a tape transport for an endless loop of magnetic tape in a cassette, and separate recording channels. Since all signals are recorded simultaneously, events in all channels are contemporaneous, and their time relationship is retained during playback and display using a system shown in FIG. 4.

Figure 4:
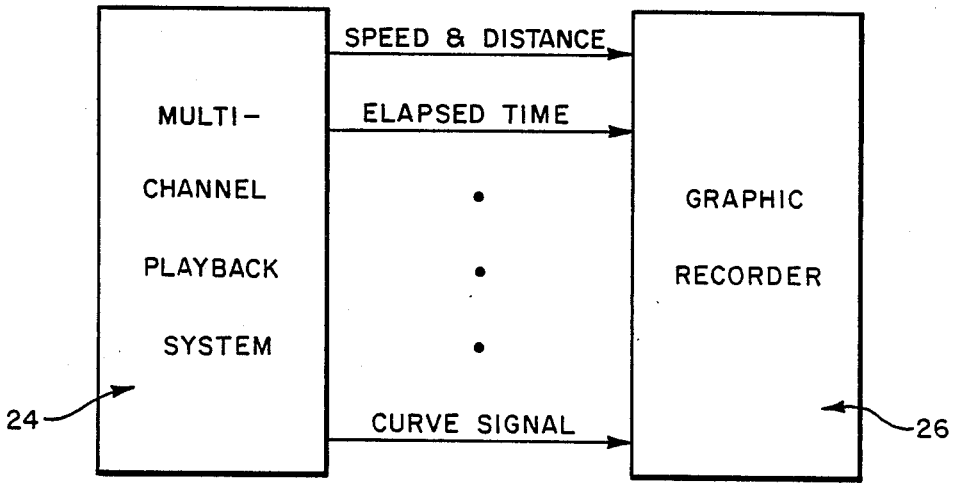
FIG. 4 is a functional block diagram of a playback and display system for an event recorder tape.

For playback and display, the magnetic tape cassette is placed in a playback system 24 in FIG. 4 and rewound to the elapsed time recording of zero. Then it is played back with a graph recorder 26 running. Both the playback system and the graph recorder have multiple channels, one for each signal. The speed and curve signal channels are analog signals displayed as continuous traces on a continuous sheet of paper on which the channel signals are recorded. Other channels may be digital, but they are also recorded contemporaneously on the continuous sheet of paper.

Figure 5:
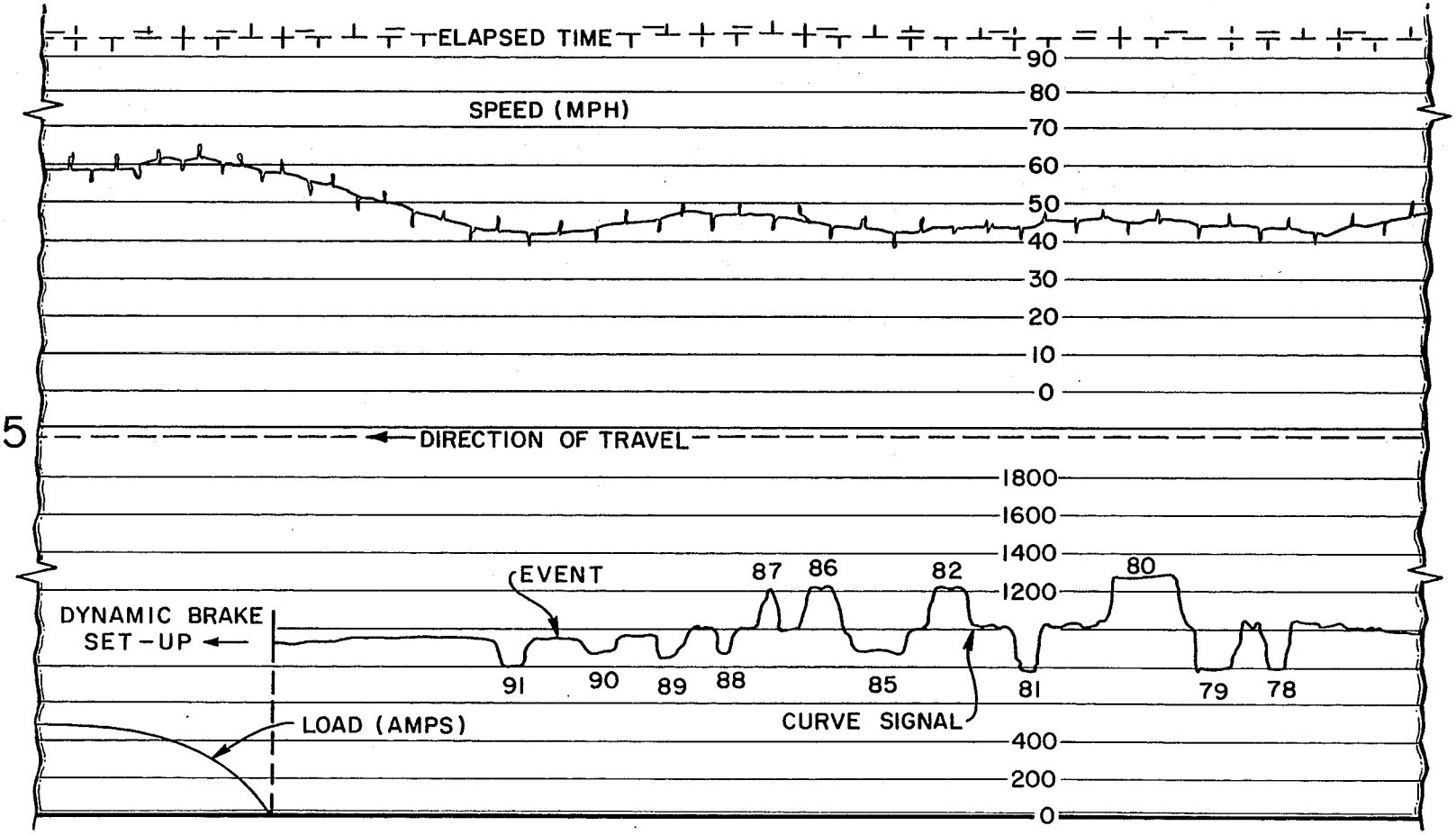
FIG. 5 illustrates a hypothetical portion of a track curvature trace produced by playback of a recorded track curvature signal, together with a speed and incremental distance information.

To facilitate reading the graph, the paper may be preprinted with a scale for speed from 0 to 90 MPH, and for the curve information from 0° to 15° left and 0° to 15° right. The multichannel playback system computes cumulative distance in miles and produces a signal blip every predetermined fraction of a mile, such as one-fourth (or one-tenth). These blips are added (superimposed) on the speed signal recorded as a continuous trace, as shown in FIG. 5.

The incremental distance marks are useful in determining the precise location of an event relative to curves recorded on the curvature channel. These curves on any segment of track are unique, and can be matched with curves on a track chart shown in FIG. 6 to determine the exact location of a recorded event (indicated by an x in FIG. 5) on that segment of track. It should be noted that the curves indicated in the track chart are in the reverse order. That is because the track curvature signal was made while traversing the segment of track in the opposite direction from that chosen for the track chart, but the curves indicated in the signal recorded on the curvature channel numbered 78 to 92 in FIG. 5 may be readily correlated with curves on the track chart numbered from 78 to 92 in FIG. 6.

Figure 6:
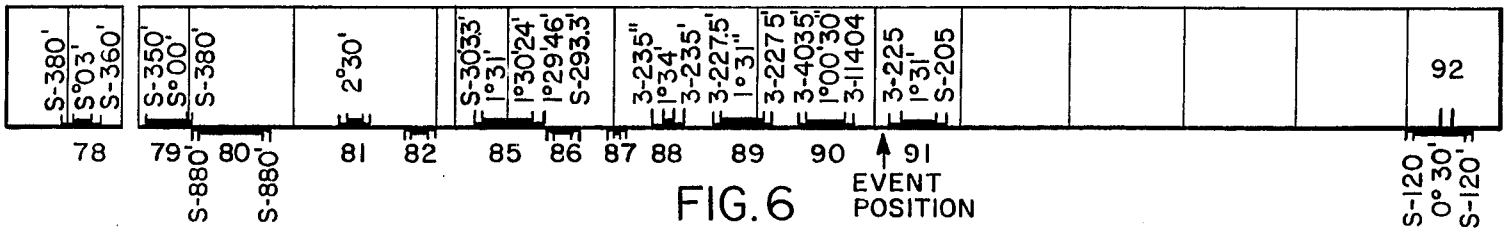
FIG. 6 illustrates a portion of a track chart corresponding to the portion over which the track curvature signal was recorded.
Figure 6A:
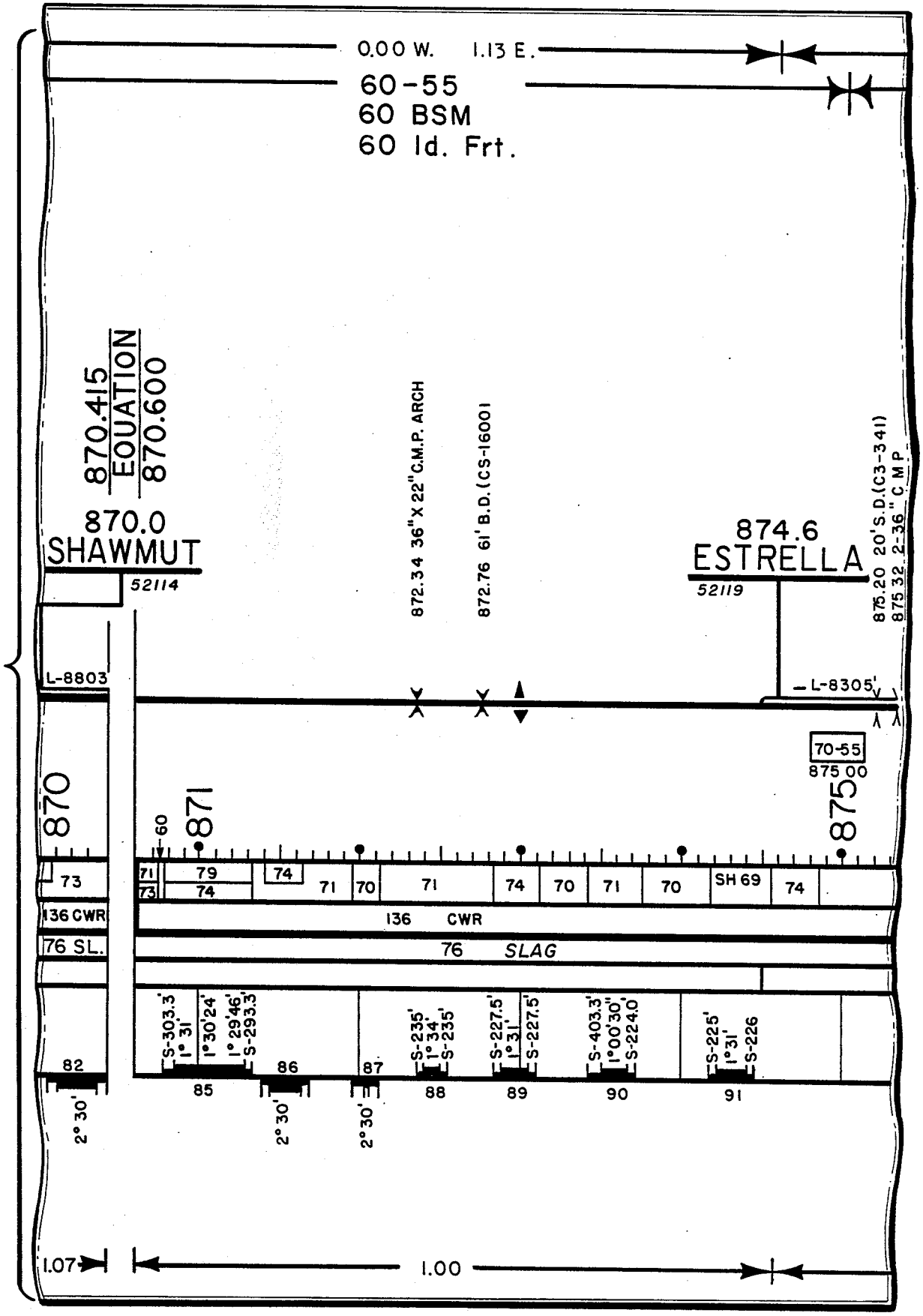
FIG. 6*a* illustrates in greater detail an enlarged segment of the track chart shown in FIG. 6.

A segment of the track chart (shown in FIG. 6 for correlation with the track curvature trace of FIG. 5 recorded by the present invention) is shown in FIG. 6*a* in a larger scale to show some of the detail not perceptable in FIG. 6. The curves identified by the numbers 82 through 91 are indicated with other track information not of direct interest here. It is sufficient to be able to correlate curvatures recorded in the trace made by the present invention with the curves on the track chart which utilizes a conventional format for presenting information about the track and geographic points along the track. The track chart reads from left to right as though traveling in that direction. Keeping in mind, it is seen that curve 82 is to the right and curve 83 is to the left. Where the curve mark and the degree of curvature is shown below a neutral line, the curve is to the right, and when shown above the line, the curve is to the left. The information is displayed along the neutral line with uniform scale of distance along the track. In correlating the curves on the curve trace, it should be recalled that in the example the direction of the curve is reversed, e.g., in traveling along the track from right to left on the track chart, curve 91 is encountered first and recorded as a right hand curve, rather than a left hand curve. Once the correlation has been made between the curve trace and the track chart, the position of an event can be fixed on the track chart. Other information on the track chart may, or may not be of interest, but it is nevertheless available.

To determine the location to within a fourth, or tenth, of a mile, it is a simple matter to find the general location relative to the curves, and then using the incremental distance marks, determine the precise location to within a fraction of a mile. For convenience in counting these incremental distance marks, the playback system may cause every mile mark to be larger than the fractional mile marks. This precise location can then be identified on the track chart with reference to mile posts. Thus, by recording the curvature signal along with other information in a track recorder, any event recorded may be geographically located within a fraction of a mile by reference to the curves displayed in the curve trace.

Figure 7:
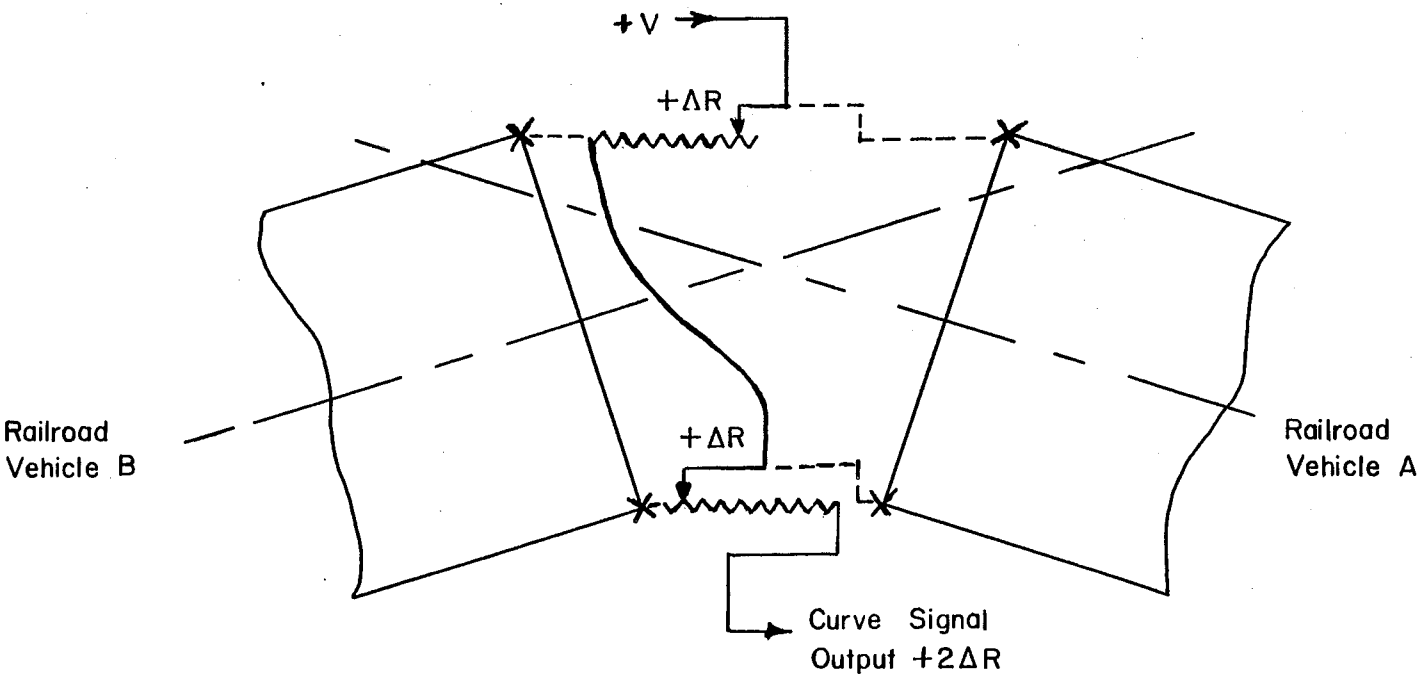
FIG. 7 illustrates an alternative embodiment for sensing track curvature with linear motion sensors.

Although a preferred embodiment of the invention has been described and illustrated herein, it is recognized that modifications and equivalents may readily occur to those skilled in the art, particularly in the arrangement for generating a signal proportional to track curvature being traversed by a railroad vehicle. One alternative referred to hereinbefore is to arrange one or two transducers connected to two vehicles to measure the angle between the centerlines of the two vehicles, as illustrated in FIG. 7, which can be considered for this purpose, as a schematic plan view. Yet another alternative is to use a rotary transducer instead of linear motion transducers on a truck. Another alternative is to arrange one or two transducers connected to two vehicles for measuring the angle between the centerlines of the two vehicles in a vertical plane. This is also illustrated in FIG. 7, which can be considered for this purpose as a schematic elevation view. Such an arrangement for measuring an angle in a vertical plane cannot be used in conjunction with track charts, but other useful engineering data can be generated with this arrangement.

Figure 8:
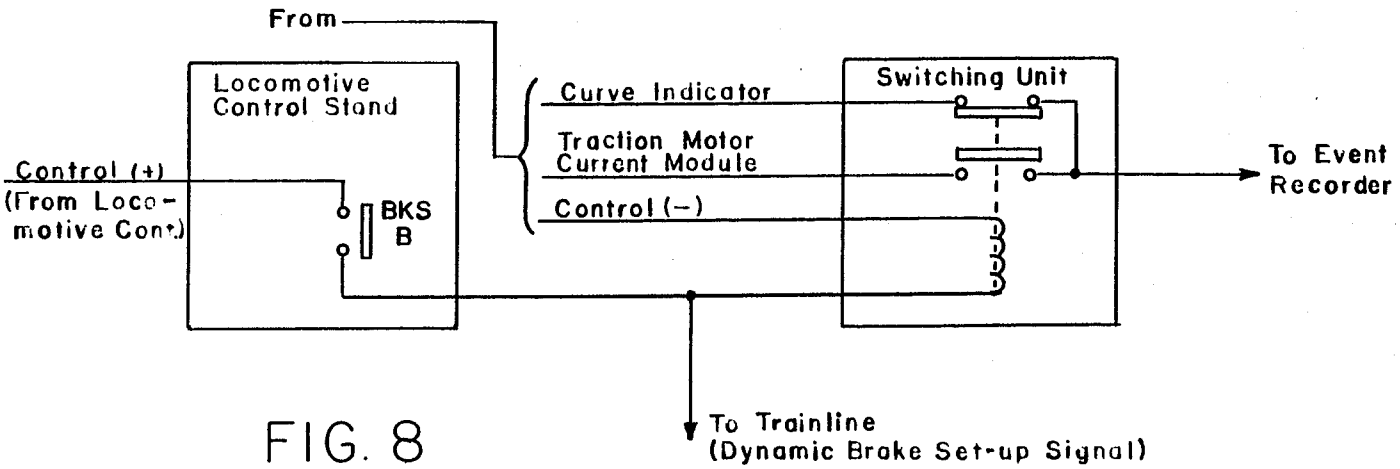
FIG. 8 illustrates a switching arrangement for recording on the same channel of an event recorder both a curve indicator signal and traction motor current.

There are also variations that may be implemented in the multichannel recorder and playback system. For example, the traction motor amperage channel may be superimposed on the curvature signal for recording on the graph paper in a manner analogous to superimposing the distance intervals on the speed signal, namely by superimposing blips at intervals proportional to traction motor amperage. Another alternative is to use the traction motor channel to record the traction motor current level only while a "dynamic brake set-up" signal is present, and to use the traction motor channel to record curvature at all other times, as illustrated in FIG. 8. This is practicable because when "motoring" the traction motor current remains constant at a given speed. Since speed is being separately recorded, it is not necessary to also record traction motor current, so it is possible to use the traction motor channel to record curvature. While braking, the converse is true; curvature data is not important, but traction motor current is. Therefore, by switching the recording channel from the curvature transducers to traction motor current transducers only while braking, it is possible to use one recording channel for two purposes. This is illustrated in FIG. 8. A dynamic brake set-up switch labeled BKS B is closed by the railroad engineer at a locomotive control stand. This closes a circuit between a positive control terminal (+) and a negative control terminal (−) to allow current to flow through the solenoid of a switching unit having double make, double break contacts, thereby switching a connection to the event recorder from the curve indicator to a traction motor curve module. The signal from the dynamic set-up switch in the locomotive control stand is also transmitted over a line labeled trainline 17 to other locomotives in the train. Note that this dynamic brake setup is independent of the air brake system used in the locomotive and all cars in the train.

An advantage of this time sharing a channel is that it makes it possible to retrofit existing event recorders having a traction motor channel with a curvature indicator for recording both a traction motor current signal and a curvature signal using a simple switching unit to switch from one to the other in response to the brake set-up signal. In either case, the proper signal conditioning circuit must be provided for each signal ahead of the switching unit.

What is claimed is:

1. A method of recording and marking the location of a railroad vehicle event with respect to curvature on a track, comprising the steps of producing a signal proportional to the degree and direction of curvature of track being traversed by said vehicle, producing a signal upon the occurrence of said event, recording said curvature signal and said event signal, playing back said curvature signal and said event signal for display, whereby the location of said vehicle at any point is indicated with reference to at least one curve in a segment of a railroad track.

2. A method as defined in claim 1 wherein elapsed time and vehicle speed signals are recorded and played back contemporaneously with said curvature signal, and the position of said vehicle is determined at any point in time with greater precision by computing distances from well defined curves using speed and elapsed time data, thereby effectively interpolating the precise position of said vehicle from at least one well defined curve.

3. A method as defined in claim 2 wherein said speed and curvature signals are recorded and played back as analog signals, and the product of speed and elapsed time is computed at predetermined intervals of distance less than a mile for display as steps along the same distance axis as said curvature signal display, thereby providing a distance scale for interpolations of said vehicle position from at least one well defined curve.

4. A method is defined in claim 1, 2 or 3 wherein said curvature signal is generated by continually sensing the angle between the longitudinal axis of said vehicle and the longitudinal axis of a truck of said railroad vehicle.

5. A method as defined in claim 4 wherein said angle between the longitudinal axis of said vehicle and the longitudinal axis of one truck of said vehicle is continually sensed by sensing the linear motion of one end of said one truck with respect to one side of said vehicle and producing a signal proportional thereto, sensing the linear motion of the other end of said one truck with respect to the other side of said vehicle and producing a signal proportional thereto, and algebraically adding said linear motion signals for producing a curvature signal having both increased sensitivity of curvature thus sensed and cancellation of any lateral displacement of said one truck with respect to said vehicle from the linear motion sensed of ends of said one truck with respect to said vehicle.

6. A method as defined in claim 5 wherein said angle between the longitudinal axis of said vehicle and the longitudinal axis of a second truck of said vehicle is continually sensed in the same manner as said one truck but of opposite sense of linear motion of said second truck with respect to sides of said vehicle, and algebraically adding curvature signals thus produced from each truck for producing a composite curvature signal with doubly increased sensitivity and separate cancellations of lateral displacement of each truck with respect to said vehicle.

7. A method is defined in claim 1, 2 or 3 wherein said curvature signal is generated by continually sensing the angle between the longitudinal axis of said vehicle and the longitudinal axis of an adjacent railroad vehicle.

8. A method as defined in claim 7 wherein said angle between the longitudinal axis of said vehicle and the longitudinal axis of said adjacent vehicle is continually sensed by sensing the linear motion of one side of said adjacent vehicle with respect to a corresponding side of said vehicle and producing a signal proportional thereto, sensing the linear motion of the other side of said adjacent vehicle with respect to the other side of said vehicle and producing a signal proportional thereto, and algebraically adding said linear motion signals for producing a curvature signal having increased sensitivity of curvature thus sensed.

9. A method of recording and determining the location of a railroad vehicle with respect to a track chart, as defined in claim 1 wherein a dynamic brake set-up signal is produced for braking a train locomotive, said curvature signal is recorded in an event recorder having a plurality of channels, one of which is for recording traction motor current, and substituting in said one channel for recording said traction motor current said curvature signal for recording in the absence of a dynamic brake set-up signal.

* * * * *